US011458514B1

(12) United States Patent
Cote' et al.

(10) Patent No.: US 11,458,514 B1
(45) Date of Patent: Oct. 4, 2022

(54) MODULAR SONIC VIBRATION BUFFER SYSTEM AND METHOD

(71) Applicant: Cote' Enterprises, Inc., Oak Harbor, WA (US)

(72) Inventors: Daniel R. Cote', Oak Harbor, WA (US); Benjamin D. Cote', Clearwater, FL (US)

(73) Assignee: Cote' Enterprises, Inc., Oak Harbor, WA (US)

( * ) Notice: Subject to any disclaimer, the term of this patent is extended or adjusted under 35 U.S.C. 154(b) by 0 days.

(21) Appl. No.: 17/588,195

(22) Filed: Jan. 28, 2022

(51) Int. Cl.
*B08B 13/00* (2006.01)
*B08B 7/02* (2006.01)
*B06B 1/10* (2006.01)

(52) U.S. Cl.
CPC ..... *B08B 7/026* (2013.01); *B06B 1/10* (2013.01)

(58) Field of Classification Search
None
See application file for complete search history.

(56) References Cited

U.S. PATENT DOCUMENTS

2014/0166059 A1* 6/2014 Kosugi ..... A61L 2/18 134/113
2017/0333955 A1* 11/2017 Jasper ..... B08B 3/024
2018/0161827 A1* 6/2018 Jasper ..... B08B 3/08

* cited by examiner

*Primary Examiner* — Eric W Golightly
(74) *Attorney, Agent, or Firm* — Seed IP Law Group LLP

(57) ABSTRACT

A modular sonic vibration buffer system includes an adapter assembly that can be attached to a sonic vibration device. The adapter assembly includes a body with apertures and a plate with arms that are received in the apertures of the body to couple the plate to the body. A cleaning tool is secured between the body and the plate to couple the cleaning tool to the adapter assembly. The sonic vibration device is operable to vibrate the cleaning tool via the adapter assembly. The system also includes additional adapter assemblies and cleaning tools with different characteristics that are attachable to the sonic vibration device in a modular nature for different cleaning or buffering applications.

20 Claims, 7 Drawing Sheets

MODULAR SONIC VIBRATION BUFFER SYSTEM AND METHOD

BACKGROUND

Technical Field

The present application pertains to modular sonic vibration buffer systems and methods, and more particularly, to modular adapters and cleaning tools for sonic vibration devices.

Description of the Related Art

In the automotive and home care industries, it is common to clean metal, plastic, and other items by hand with a cleaning solution and a rag. However, the use of conventional systems and methods involves significant manual input from the user. In response, certain cleaning devices, such as polishing wheels, have been proposed. These proposed solutions also suffer from a number of deficiencies and disadvantages that limit their applicability and adoption by common consumers.

For example, the proposed solutions are difficult to apply to small spaces. In other words, sharp bends, corners, creases, grooves, gaps, crevices, and other like areas that are common features of automobiles, home appliances, and other consumer products are particularly difficult to clean or buffer according to conventional systems and methods. In addition, conventional cleaning devices are specialized units sold at a prohibitively high cost only for cleaning large items, which limits their adoption by common consumers. Polishing wheels may be available at a lower cost, but polishing wheels cannot effectively clean small spaces and corners, such that they are likewise an incomplete solution.

Accordingly, it would be a technological improvement to have a system and method that could easily and effectively clean or buffer products with different sizes, shapes, and configurations. The availability of such systems and methods would greatly improve the longevity of automobiles, home appliances, and other products while simultaneously reducing waste associated with replacing these products and improving convenience for consumers.

BRIEF SUMMARY

Briefly stated, embodiments of the present disclosure include adapter assemblies for attaching cleaning tools with different buffering tips to a sonic vibration device with the sonic vibration device operable to vibrate the buffering tips to enable cleaning with the tools. The adapter assemblies and cleaning tools have different sizes, shapes, configurations, and other characteristics that are interchangeable with the sonic vibration device in a modular nature for different cleaning and buffering applications. The cleaning tools are designed for a variety of different applications that improve upon conventional cleaning systems and methods by increasing efficiency and efficacy of cleaning components with different sizes and shapes.

In one or more embodiments, a modular sonic vibration buffer system includes: an adapter assembly having a cleaning tool mounting socket, including an adapter body having a channel and a pair of opposing cavities, and a plate removably coupled to the adapter body, the plate having a pair of opposing arms receivable in the pair of opposing cavities of the adapter body, wherein when the plate and the channel of the adapter body are coupled together the cleaning tool mounting socket is formed between the channel of the adapter body and the plate; a first cleaning tool including a support and a buffering tip; and a second cleaning tool including a support and a buffering tip, the buffering tip of the second cleaning tool having a different buffering shape than the buffering tip of the first cleaning tool, the first cleaning tool and the second cleaning tool being interchangeably coupleable to the adapter assembly with the support of the first cleaning tool or the support of the second cleaning tool received in the cleaning tool mounting socket of the adapter assembly.

In some aspects, the modular sonic vibration buffer system includes: the buffering tip of the first cleaning tool and the buffering tip of the second cleaning tool including one of cotton, foam, or rubber; the plate including a pair of ridges between the pair of opposing arms; the channel of the adapter body being located between the pair of opposing cavities of the adapter body; the adapter body including a first end and a second end opposite to the first end, the adapter body further including a mounting hole in the first end of the adapter body, the channel and the pair of opposing cavities being located at the second end of the adapter body; and a sonic vibration device with a mounting shaft, the adapter assembly being coupleable to the sonic vibration device with the mounting shaft of the sonic vibration device being receivable in the mounting hole of the adapter body, the sonic vibration device operable to vibrate one of the first cleaning tool or the second cleaning tool.

In one or more embodiments, a modular sonic vibration buffer system includes: an adapter assembly, including an adapter body having a pair of apertures and a plate removably coupled to the adapter body, the plate having a pair of arms receivable in the pair of apertures of the adapter body; a first cleaning tool having a buffering tip; and a second cleaning tool having a buffering tip, the tip of the second cleaning tool having a different buffering shape than the buffering tip of the first cleaning tool, the first cleaning tool and the second cleaning tool being interchangeably coupleable to the adapter assembly.

In some aspects, the modular sonic vibration buffer system includes: the adapter body including a mounting hole extending into the adapter body, the system further comprising a sonic vibration device with a mounting shaft, the adapter assembly coupled to the sonic vibration device with the mounting shaft of the sonic vibration device being receivable in a mounting hole of the adapter body, the sonic vibration device operable to vibrate one of the first cleaning tool or the second cleaning tool; the adapter body including a first end and a second end opposite to the first end, the mounting hole extending into the first end of the adapter body and the pair of apertures being located at the second end of the adapter body; the adapter body including a channel and the plate includes a pair of ridges extending from the plate, the pair of ridges of the plate received in the channel of the adapter body; the first cleaning tool including a support and the second cleaning tool including a support, the support of the first cleaning tool and the support of the second cleaning tool interchangeably received between the pair of ridges of the plate; the adapter assembly including a cleaning tool mounting socket defined by the pair of ridges of the plate and the adapter body, the first cleaning tool and the second cleaning tool interchangeably received in the cleaning tool mounting socket of the adapter assembly; at least one of the arms of the pair of arms of the plate including a securement ridge receivable in one of the pair of apertures of the adapter body in a snap fit connection; and the buffering tip of the first cleaning tool and the buffering tip of the second cleaning tool including one of cotton, foam, or rubber.

In one or more embodiments, a modular sonic vibration buffer system includes: a first adapter assembly, including an adapter body having a channel and a pair of apertures, the channel located between the pair of apertures, and a plate removably coupled to the adapter body, the plate having a pair of arms receivable in the pair of apertures of the adapter body, wherein when the plate and the adapter body are coupled together, a cleaning tool mounting socket is formed; a first cleaning tool having a buffering tip; and a second cleaning tool having a buffering tip, the buffering tip of the second cleaning tool having a different buffering shape than the buffering tip of the first cleaning tool, the first cleaning tool and the second cleaning tool being interchangeably coupleable to the first adapter assembly.

In some aspects, the modular sonic vibration buffer system includes: a second adapter assembly having a length that is different than a length of the first adapter assembly, the second adapter assembly including an adapter body having a channel and a pair of apertures, the channel located between the pair of apertures, and a plate removably coupled to the adapter body, the plate having a pair of arms receivable in the pair of apertures of the adapter body, wherein when the plate and the adapter body are coupled together, a cleaning tool mounting socket is formed, the first cleaning tool and the second cleaning tool being interchangeably coupleable to the second adapter assembly; a sonic vibration device, the first adapter assembly and the second adapter assembly interchangeably coupleable to the sonic vibration device; the buffering tip of the first cleaning tool being a foam block and the buffering tip of the second cleaning tool being a cotton swab with a pointed or rounded shape; the buffering tip of the first cleaning tool having a length and a width each greater than a length and a width of the buffering tip of the second cleaning tool; and the first cleaning tool including a support coupled to the buffering tip and the second cleaning tool including a support coupled to the buffering tip, the support of the first cleaning tool or the support of the second cleaning tool being receivable in the cleaning tool mounting socket of the first adapter assembly.

BRIEF DESCRIPTION OF THE SEVERAL VIEWS OF THE DRAWINGS

The present disclosure will be more fully understood by reference to the following figures, which are for illustrative purposes only. These non-limiting and non-exhaustive embodiments are described with reference to the following drawings, wherein like labels refer to like parts throughout the various views unless otherwise specified. The sizes and relative positions of elements in the drawings are not necessarily drawn to scale in some figures. For example, the shapes of various elements are selected, enlarged, and positioned to improve drawing legibility. In other figures, the sizes and relative positions of elements in the drawings are exactly to scale. The particular shapes of the elements as drawn may have been selected for ease of recognition in the drawings. The figures do not describe every aspect of the teachings disclosed herein and do not limit the scope of the claims.

DETAILED DESCRIPTION

Persons of ordinary skill in the art will understand that the present disclosure is illustrative only and not in any way limiting. Other embodiments of the presently disclosed systems, devices, and methods readily suggest themselves to such skilled persons having the assistance of this disclosure.

Each of the features and teachings disclosed herein can be utilized separately or in conjunction with other features and teachings to provide modular sonic vibration buffer devices, systems, and methods. Representative examples utilizing many of these additional features and teachings, both separately and in combination, are described in further detail with reference to attached FIGS. 1-10C. This detailed description is merely intended to teach a person of skill in the art further details for practicing aspects of the present teachings and is not intended to limit the scope of the claims. Therefore, combinations of features disclosed in the detailed description may not be necessary to practice the teachings in the broadest sense, and are instead taught merely to describe particularly representative examples of the present teachings.

In the description below, for purposes of explanation only, specific nomenclature is set forth to provide a thorough understanding of the present system and method. However, it will be apparent to one skilled in the art that these specific details are not required to practice the teachings of the present devices, systems and methods.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help understand how the present teachings are practiced, but are not intended to limit the dimensions and the shapes shown in the examples in some embodiments. In some embodiments, the dimensions and the shapes of the components shown in the figures are intended to limit the dimensions and the shapes of the components.

Although the present disclosure will proceed to describe certain non-limiting examples of a modular sonic vibration buffer systems, devices, and methods for cleaning and buffering automotive and home care products, which may be made of metal, it is to be appreciated that the concepts of the disclosure can be applied beyond the automotive and home care industries and may be used with any product that is manually cleaned. Accordingly, the present disclosure is not limited to the examples provided below.

Figure 1:
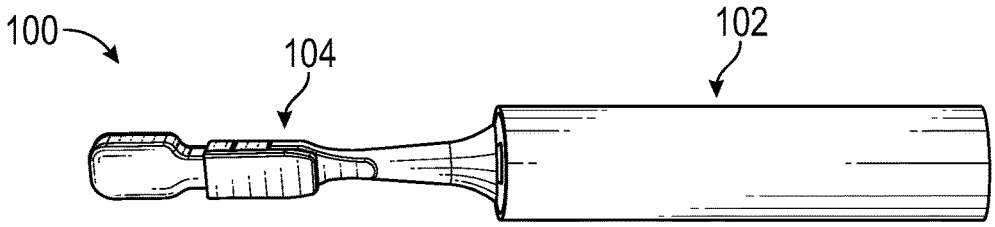
FIG. 1 is an isometric view of an embodiment of a modular sonic vibration buffer system according to the present disclosure.

FIG. 1 is an isometric view of an embodiment of a modular sonic vibration buffer system 100 (which may also be referred to herein as a system 100). The system 100 includes a sonic vibration device 102 and an adapter assembly 104 removably coupled to the sonic vibration device 102. As explained in more detail below, a number of different adapter assemblies 104 can be coupled to the sonic vibration device 102 for different applications. Although not specifically shown, the sonic vibration device 102 may include a motor and a power source, such as a rechargeable or replaceable battery, for providing electricity to the motor. The motor converts the electricity into sonic or ultrasonic waves that vibrate the adapter assembly 104. The sonic vibration device 102 may also include one or more switches or other user controls, such as an ON/OFF switch and a switch for adjusting the power level or vibration intensity, among other features. In some embodiments, the sonic vibration device 102 is any commercially available sonic or ultrasonic vibration device. In other embodiments, the sonic vibration device 102 is a specialized component that is specifically configured to function with the modular sonic vibration buffer system 100.

Figure 2:
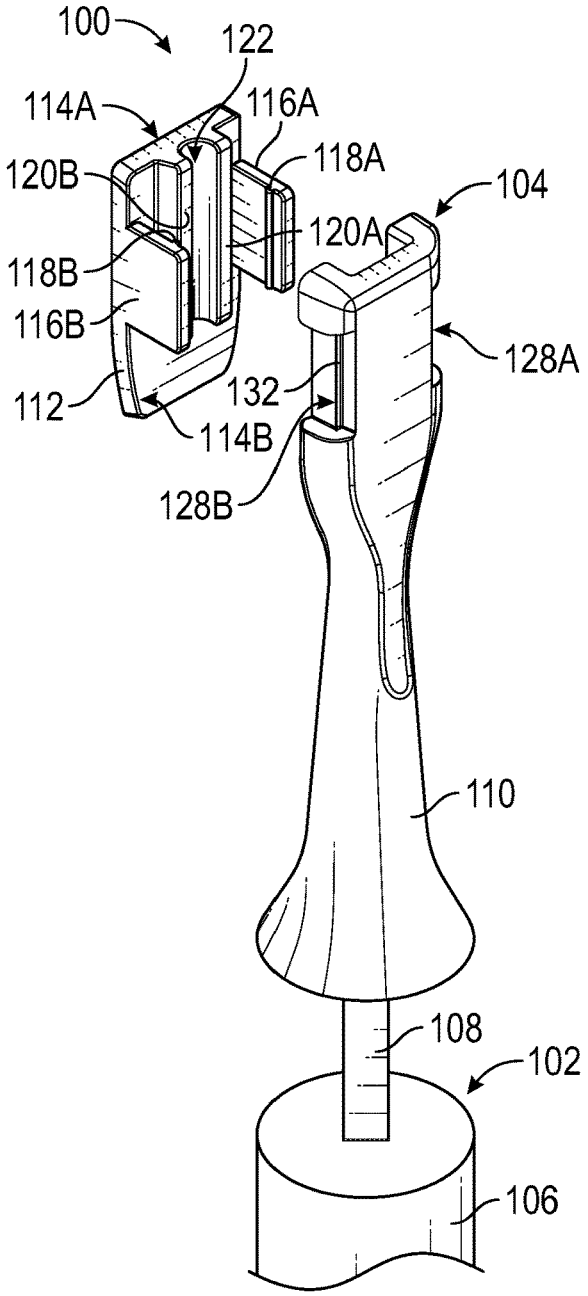
FIG. 2 is an exploded isometric view of the system of FIG. 1.

FIG. 2 is an exploded isometric view of the system 100. As shown in FIG. 2, the sonic vibration device 102 may include a housing 106 and a mounting shaft 108 coupled to and extending from the housing 106. The mounting shaft 108 is received in the adapter assembly 104 to couple the adapter assembly 104 to the device 102. The motor, power source, and other controls for the device 102 may be disposed in or on the housing 106 with the mounting shaft 108 transmitting the sonic or ultrasonic vibrations from the device 102 to the adapter assembly 104. The adapter assembly 104 includes an adapter body 110 and a plate 112 removably coupled to the adapter body 110.

Figure 5:
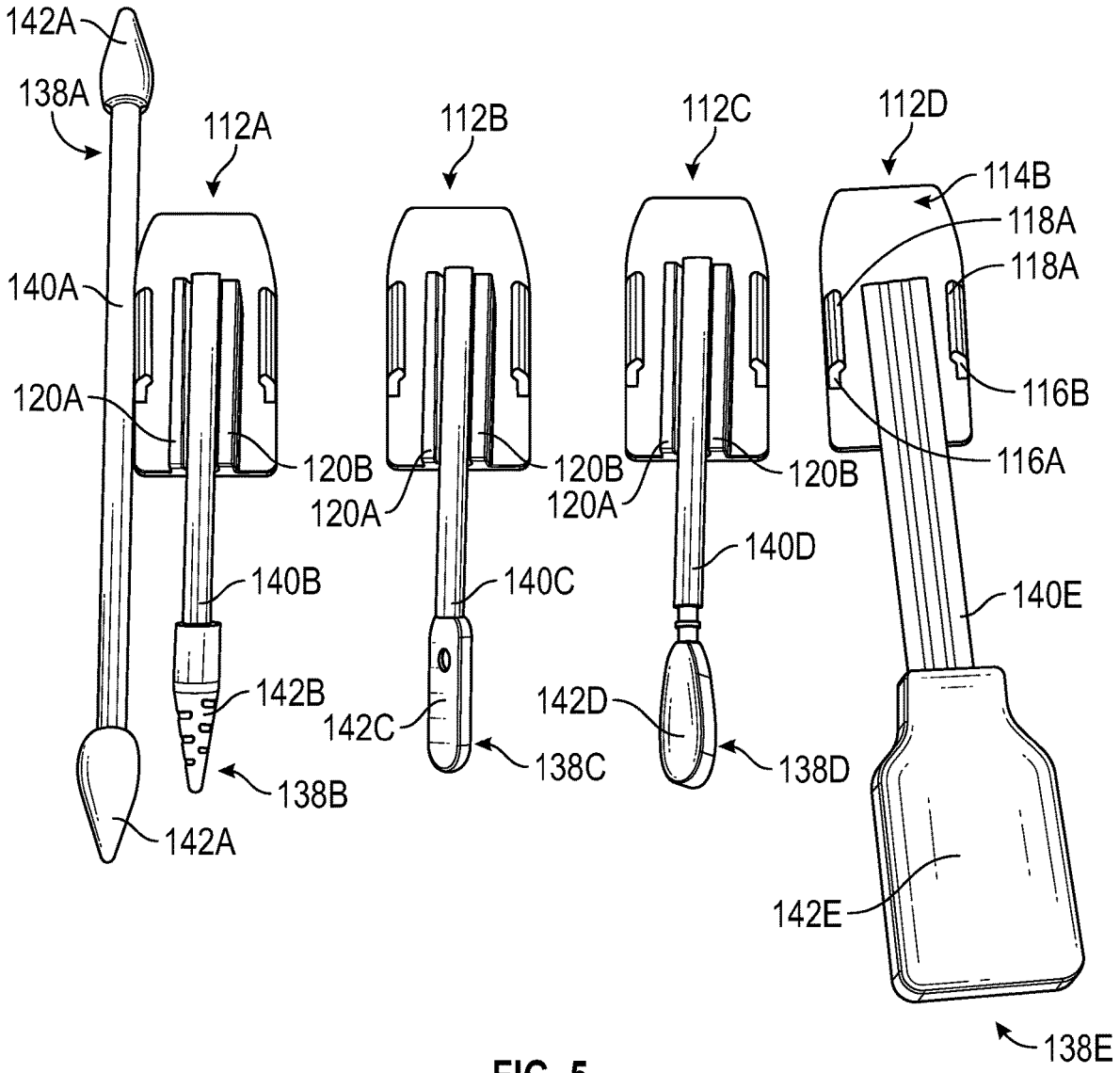
FIG. 5 is an array of top plan views of a plate and different cleaning tools of the adapter assembly of FIG. 2.

The plate 112 includes a first surface 114A and a second surface 114B opposite to the first surface 114A. The first surface 114A may be flat and planar while the plate 112 includes a pair of opposing arms 116A, 116B extending from the second surface 114B. The arms 116A, 116B may be positioned at an outer peripheral edge of the plate 112 on opposite sides of the plate 112. In some embodiments, the arms 116A, 116B may generally extend perpendicularly from the second surface 114B except a tip or terminal end of the arms 116A, 116B may be rounded, curved, or may have a ridge or other protrusion for securing to and engaging the adapter body 110, as shown in FIG. 5. In other embodiments, the arms 116A, 116B are positioned at any angle relative to the second surface 114B and the plate 112. In FIG. 2, a first arm 116A includes a securement ridge 118A and a second arm 116B includes a securement ridge 118B with the securement ridges 118A, 118B located along a length or height of the arm 116B. In some embodiments, the arms 116A, 116B are identical (i.e., both have a rounded or curved terminal end best shown in FIG. 5, or both have a linear angled securement ridge, such as the securement ridges 118A, 118B extending generally perpendicular to the arms 116A, 116B as in FIG. 2), while in other embodiments the arms 116A, 116B are different from each other (i.e., one has a rounded or curved terminal end while the other arm has a linear angled securement ridge 118A, 118B).

The plate 112 further includes a pair of opposing plate ridges 120A, 120B extending from the second surface 114B. The plate ridges 120A, 120B cooperate to define a channel 122 that is structured to receive and secure a cleaning tool, as described herein. In some embodiments, the plate ridges 120A, 120B begin at the top of the plate 112 in the orientation in FIG. 2 and have a length that is greater than, less than, or equal to the length of the arms 116A, 116B with the plate ridges 120A, 120B positioned between the arms 116A, 116B. In at least one embodiment, the channel 122 is centered relative to the second surface 114B with the plate ridges 120A, 120B spaced equidistant from each other and the arms 116A, 116B. The channel 122 may also be spaced from the center of the second surface 114B with the plate ridges 120A, 120B in any selected spacing. In addition, the plate ridges 120A, 120B may be spaced from each other by a selected distance (i.e., the size of the channel 122 can be selected based on the position of the ridges) to fit different types and sizes of cleaning tools. The plate ridges 120A, 120B are optional and the plate 112 may include only the arms 116A, 116B, or a different coupling or attachment structure in some embodiments. Thus, the second surface 114B of the plate 112 may also generally be flat and planar except for the arms 114A, 114B in one or more embodiments.

Figure 3:
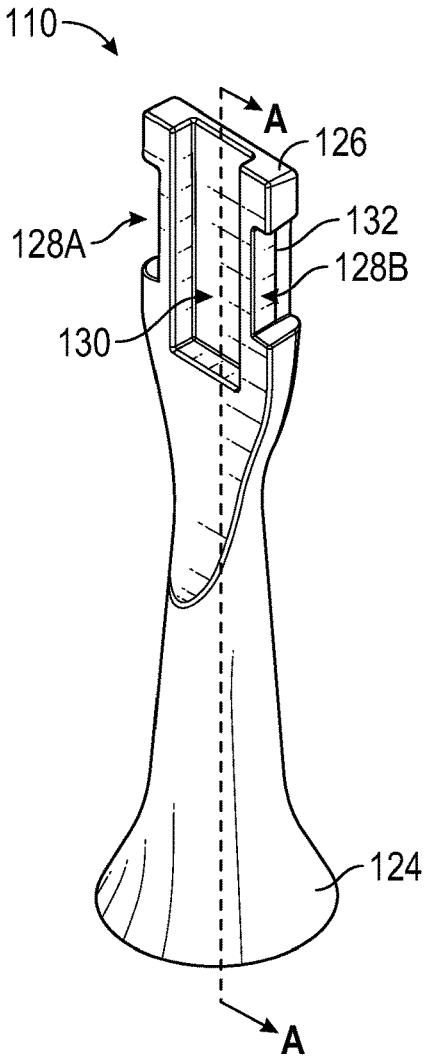
FIG. 3 is an isometric view of an adapter body of the adapter assembly of FIG. 2.

FIG. 3 is an isometric view of the adapter body 110. The adapter body 110 includes a first end 124 (or a base 124) and a second end 126 (or a plate mounting end 126). The second end 126 may be narrower relative to the first end 124 in order to reduce the profile of the adapter assembly 104 when the plate 112 is coupled to the adapter body 110, as shown more clearly in FIG. 4. The body 110 includes a pair of opposing cavities 128A, 128B (which may also be referred to herein as a pair of apertures 128A, 128B or apertures 128A, 128B) on opposite sides of the body 110 proximate the second end 126. In some embodiments, the cavities 128A, 128B are spaced from the second end 126 by a selected distance. The body 110 also has a channel 130 extending into the body 110 at the second end 126. The channel 130 may have a length that is greater than a length of the cavities 128A, 128B (i.e., the channel 130 extends beyond the cavities 128A, 128B) in some embodiments of the disclosure. The channel 130 is formed in a surface of the body 110 that is perpendicular to a surface of the body 110 which includes the cavities 128A, 128B. In some embodiments, the channel 130 may also be centered relative to the body 110 with one cavity 128A, 128B on either side of the channel 130 (i.e., the channel 130 is between the cavities 128A, 128B). In operation, and with reference to FIG. 2 and FIG. 3, the arms 116A, 116B of the plate 112 are received in the cavities 128A, 128B of the adapter body 110 to couple the plate 112 to the adapter body 110. The securement ridges 118A, 118B of the arms 116A, 116B assist with securing the plate 112 to the body 110 in a friction fit or a snap fit connection, among other coupling techniques. For example, the securement ridges 118A, 118B of the arms 116A, 116B may engage the adapter body 110 to hold the plate 112 in place under a restoring or elastic force from the arms 116A, 116B. In some embodiments, the securement ridges 118A, 118B engage a corresponding ridge or securing mechanism 132 that extends from the body 110 into the second cavity 128B to prevent the plate 112 from pulling away from the body 110 during use. As shown in FIG. 2, the securing mechanism 132 may be a cutout or recess in the cavities 128A, 128B of the adapter body 110 that defines a ledge for engaging the securement ridges 118A, 118B in one or more embodiments. Further, the plate ridges 120A, 120B of the plate 112 are received in the channel 130 of the body 110. As will be explained in additional detail below, the adapter body 110 covers an open side of the channel 122 in the plate 112 to form a cleaning tool mounting socket in the completed adapter assembly 104.

The modular sonic vibration buffer system 100 provides several technological improvements. Notably, it can be challenging to connect attachments to sonic vibrational systems because vibrations from the system have a tendency to cause the attachments to detach or otherwise disengage from each other or the system, or both. This can be particularly challenging with systems having numerous or a larger number of components. In this regard, the sonic vibration buffer system 100 enables a modular system to be employed that has numerous interchangeable pieces, but still provides secure attachment mechanisms that stay locked in place without coming loose due to the vibrations of the system.

Figure 4:
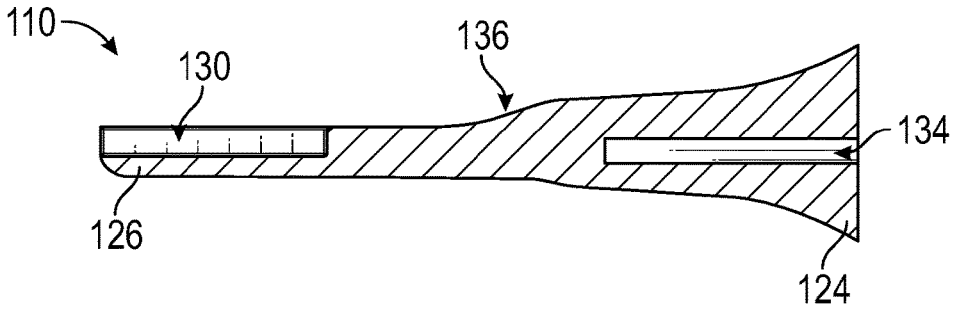
FIG. 4 is a cross-sectional view of the adapter body along line A-A in FIG. 3.

FIG. 4 is a cross-sectional view of the adapter body 110 along line A-A in FIG. 3. The body includes the channel 130 at the second end 126 as well as a mounting hole 134 extending into the first end 124 of the adapter body 110. The mounting hole 134 is sized and shape to receive the mounting shaft 108 of the sonic vibration device 102 (FIG. 2) to couple the adapter body 110, and therefore the adapter assembly 104, to the sonic vibration device 102. The mounting shaft 108 of the sonic vibration device 102 (FIG. 2) and the mounting hole 134 may have any selected, size, shape, and configuration. In some embodiments, the mounting hole 134 has a size, shape, and configuration corresponding to a tip of a commercially available sonic vibration device. The mounting hole 134 may also have a universal configuration for use with different sonic vibration devices 102. Further, the adapter body 110 may be removably coupled to the mounting shaft 108 of the sonic vibration device 102 or the body 110 may be permanently coupled to the mounting shaft 108 with the plate 112 being removably coupled to the body 110.

In a further embodiment, the system 100 includes an additional base coupleable to the sonic vibration device 102 with the base having a mounting shaft that is structured to be coupled to the adapter assembly 104. In other words, such a system 100 includes a "universal adapter" for coupling different sonic vibration devices 102 to the adapter assembly 104. In some embodiments, the additional base or "universal adapter" includes one or more bases that are structured to fit different sonic vibration devices 102. In a non-limiting example, the system 100 includes a first base coupleable to a first type of sonic vibration device 102 and a second base coupleable to a second, different type of sonic vibration device 102. Each of the first and second bases have a mounting shaft or other coupling structure that is compatible with the adapter assembly 104. Thus, the operator can select a base for different sonic vibration devices 102 with each base being compatible with the adapter assembly 104. As mentioned above, the base may also be a single universal adapter designed to fit most, if not all, commercially available sonic vibration devices 102.

FIG. 4 also illustrates that thickness of the adapter body 110 changes over the length of the body 110 due, at least in part, to the chamfers or cutouts in the second end 126 of the body 110 best shown in FIG. 2 and FIG. 3. Specifically, the body 110 may have a greatest thickness or diameter at the first end 124 with the thickness or diameter tapering to a minimum at the second end 126. The body 110 may also have a transition portion spaced approximately equidistant from the ends 124, 126 with a thickness or diameter that is between the thickness or diameter at the first end 124 and the second end 126. The design of the body 110, including its tapered shape, provides for a lower profile when the plate 112 is coupled to the body 110 in order to enable more effective and efficient cleaning in small spaces as well as a modern and minimal design aesthetic.

FIG. 5 is an array of top plan views of different configurations of the plate 112. For clarity, the plates have been labeled 112A-112D from left to right in the orientation shown in FIG. 5. In some embodiments, the plates 112A-112C are identical to plate 112 in FIG. 2 and have been provided to show the interaction of the plate 112 with different cleaning tools, as explained further below. In yet further embodiments, the plates 112A-112C may have plate ridges 120A, 120B with different spacing (i.e., and thus channels 122 of different sizes) to accommodate different cleaning tools. As shown in FIG. 5, the system 100 includes cleaning tools 138A-138E that are coupleable to the plates 112A-112D. Each cleaning tool 138A-138E includes a respective support 140A-140E and a respective at least one buffering tip 142A-142E. The first cleaning tool 138A is provided as an example to demonstrate that the cleaning tools 138A-138E may initially have buffering tips 142A-142E at both ends, with the supports 140B-140E cut in half to fit the supports 140B-140E in the plates 112A-112D.

Further, FIG. 5 illustrates that each of the cleaning tools 138A-138E has at least a different buffering tip 142A-142E, and in some embodiments, has a different support 140A-140E as well. Although FIG. 5 provides examples of several buffering tip shapes and styles, the examples in FIG. 5, as well as other examples herein, are not intended to be limiting, but rather, the buffering tips 142A-142E may have various selected design, including rounded, curved, angled, rectilinear, pointed, elongated, blunt, tapered, step-down or step-up, and others, and may have a standard geometric shape or an irregular shape.

For example, the second cleaning tool 138B has a generally cylindrical support 140B with a constant diameter and a buffering tip 142B that begins with a diameter greater than the diameter of the support 140B and tapering to terminate in a cylindrical point that may have a diameter equal to or less than the diameter of the support 140B. By contrast, the fifth cleaning tool 138E has a generally rectangular support 140E with a buffering tip 142E with a generally rectangular shape that begins with a smaller width and steps up to a larger width. The buffering tip 142E also includes wide, flat, and planar major surfaces (i.e., top and bottom surfaces in the orientation shown in FIG. 5) for cleaning or buffering large surfaces and narrow minor surfaces (i.e., side surfaces in the orientation shown in FIG. 5) for cleaning or buffering smaller spaces.

Thus, the operator can select a cleaning tool 138A-138E with a desired size and shape for different cleaning and buffering applications and attach it to a plate 112A-112D and the adapter body 110. When a different tool 138A-138E would be advantageous for a different application, the operator can switch the tool 138A-138E by removing the plate 112A-112D and replacing the current tool 138A-138E with the new tool 138A-138E. The modular and interchangeable nature of the different components enables effective and efficient cleaning of a wide range of products, as well as large and small products. FIG. 5 also illustrates that in some embodiments, the arms 116A, 116B of the plates 112A-112D are the same and include a rounded or curved securement ridge 118A, as described above with reference to FIG. 2.

Figure 6:
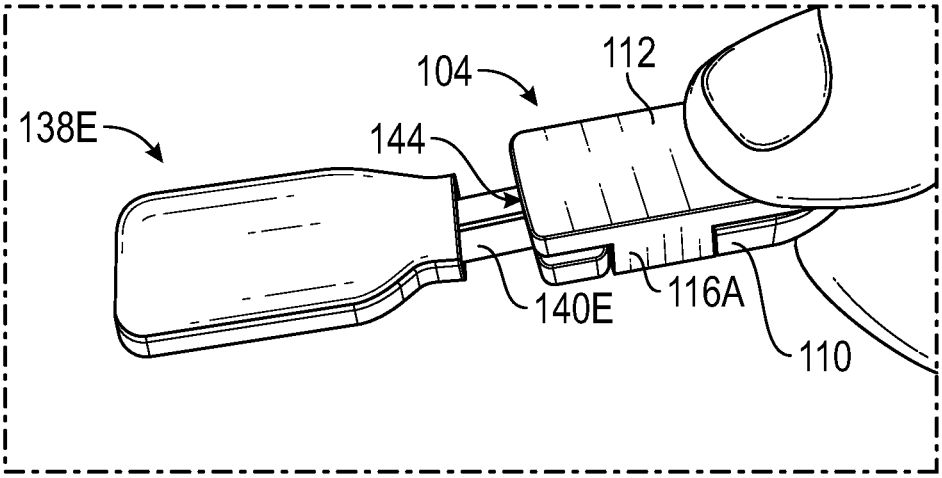
FIG. 6 is an isometric view of the adapter assembly of FIG. 2 coupled to a cleaning tool.

FIG. 6 is an isometric view of one embodiment of the adapter assembly 104 coupled to the cleaning tool 138E. As shown in FIG. 6, the user can couple the plate 112 to the body 110 by aligning the arms 116A, 116B of the plate 112 in the cavities 128A, 128B (FIG. 3) and pressing the plate 112 and the body 110 together in a snap fit connection. As referenced above, the adapter assembly 104 includes a cleaning tool mounting socket 144 that is shown more clearly in FIG. 7. The support 140E of the cleaning tool 138E is received in the cleaning tool mounting socket 144, with the cleaning tool mounting socket 144 defined by the channel 130 (FIG. 3) of the adapter body 110 and the plate 112, or in some embodiments, by the plate ridges 120A, 120B of the plate 112. To change cleaning tools, the user manipulates the arms 116A, 116B to uncouple the plate 112 from the body 110, removes the current tool 138E, selects a new tool 138A-D (FIG. 5) and attaches the plate 112 to the body 110 again.

Figure 7:
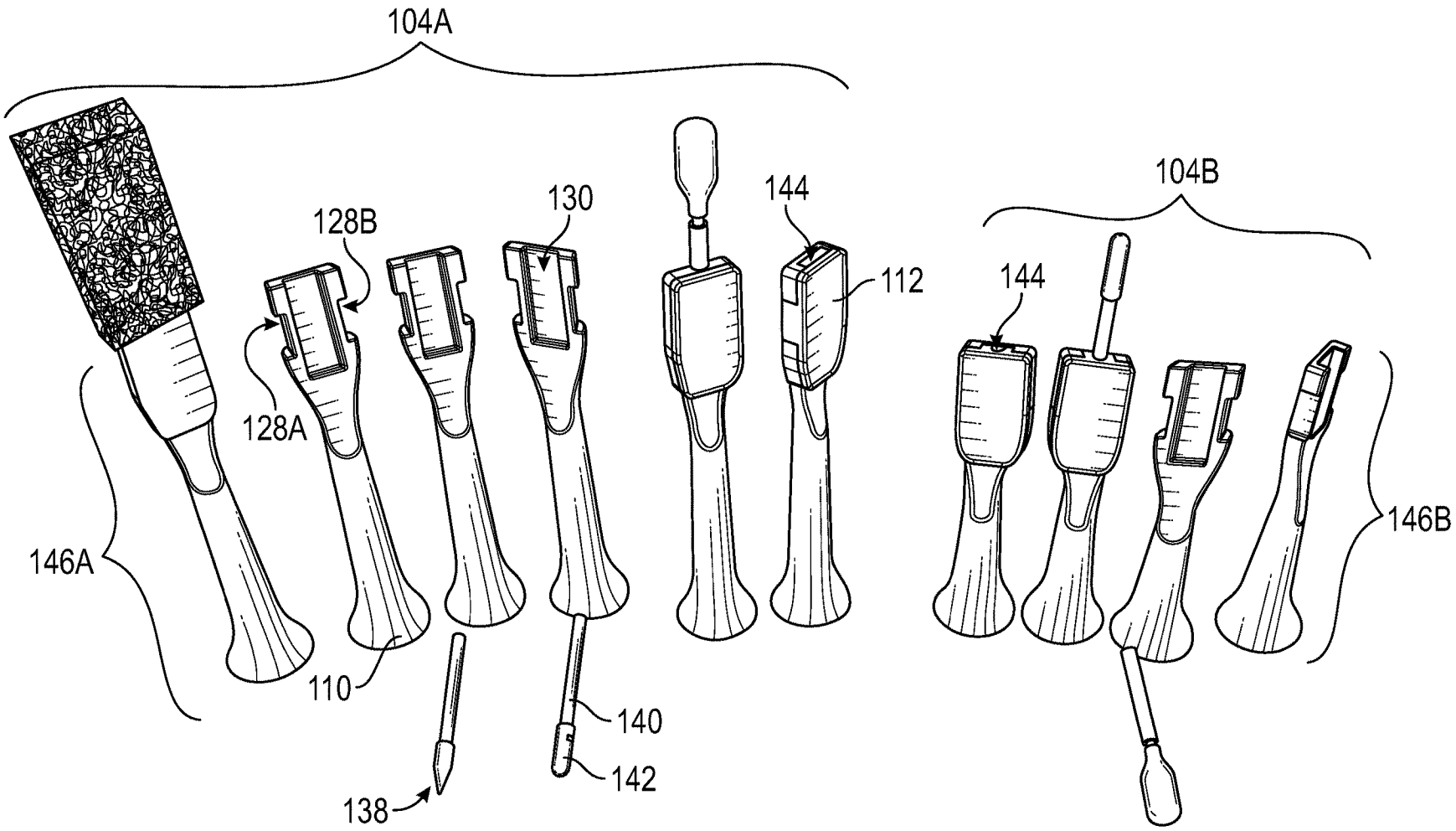
FIG. 7 is an array of isometric views of different adapter assemblies and cleaning tools according to the present disclosure.

FIG. 7 is an array of isometric views of different adapter assemblies 104 and cleaning tools illustrating the modular nature of the system 100. For convenience, the cleanings tools are generally referred to with reference number 138 despite differences between the tools 138 shown in FIG. 7. In particular, FIG. 7 illustrates a plurality of first adapter assemblies 104A and a plurality of second adapter assemblies 104B. The first adapter assemblies have a height 146A that is greater than a height 146B of the second adapter assemblies 104B. Other features of the first adapter assemblies 104A may be different than the second adapter assemblies 104B as well, including the diameter of the adapter body 110, the size and shape of the cavities 128A, 128B and the channel 130 in the adapter body 110. Differences in the adapter body 110 may also correspond to differences in the plate 112, including to the arms 116A, 116B, the plate ridges 120A, 120B, and the channel 122 of the plate 112 (FIG. 2). Except as otherwise indicated herein, each of the adapter assemblies 104 can be made of a number of different materials, including but not limited to plastic, polymer, 3D printable materials, metal, and wood, as well as other materials of different durometer (i.e., hardness) or compliance (i.e., flexibility). The buffering tips 142 of the cleaning tools 138 may be pads, swabs, picks, and the like made of different materials, including but not limited to cotton, foam, and rubber. Thus, a first adapter assembly 104A may be different than a second adapter assembly 104B and the cleaning tools 138 may have different supports 140 and tips 142, as described herein, with the different cleaning tools 138 being usable with any of the adapter assemblies 104A, 104B in a modular nature.

FIG. 7 also illustrates the cleaning tool mounting socket 144 of the adapter assemblies 104A, 104B for receiving the supports 140 of the cleaning tools 138 in additional detail. For clarity, the cleaning tool mounting socket 144 of a first adapter assembly 104A is labeled 144A and the cleaning tool mounting socket 144 of a second adapter assembly 104B is labeled 144B. As alluded to above, the cleaning tool mounting socket 144 is defined by the adapter body 110 and the plate 112. In some embodiments, the cleaning tool mounting socket 144A has a generally rectangular shape that is similar in size and shape to the channel 130 in the adapter body 110 in order to receive a larger support 140 of a cleaning tool 138. The cleaning tool mounting socket 144A is bounded by sidewalls of the body 110 that define the channel 130 and the plate 112.

In further embodiments, the cleaning tool mounting socket 144B has a semi-circular or circular shape bounded by the plate ridges 120A, 120B of the plate 121 (FIG. 2) and the portion of the adapter body 110 defining the bottom of the channel 130 in the body 110. The cleaning tool mounting socket 144A may therefore have a smaller volume to receive a smaller support 140 of a cleaning tool 138. Thus, the adapter assemblies 104A, 104B may have different cleaning tool mounting sockets 144A, 144B to accommodate different supports 140 of various cleaning tools 138, as well as different lengths, among other differences. Despite these differences, the adapter assemblies 104A, 104B are modular in nature and are each attachable to the sonic vibration device 102 (FIG. 2) with the different cleaning tools 138 for various cleaning and buffering applications. Further, the plates 112 (i.e., plate 112A with plate ridges 120A, 120B and plate 112D without the plate ridges 120A, 120B) are interchangeable with any of the adapter bodies 110 in the assemblies 104A, 104B to provide further customization.

Figure 8:
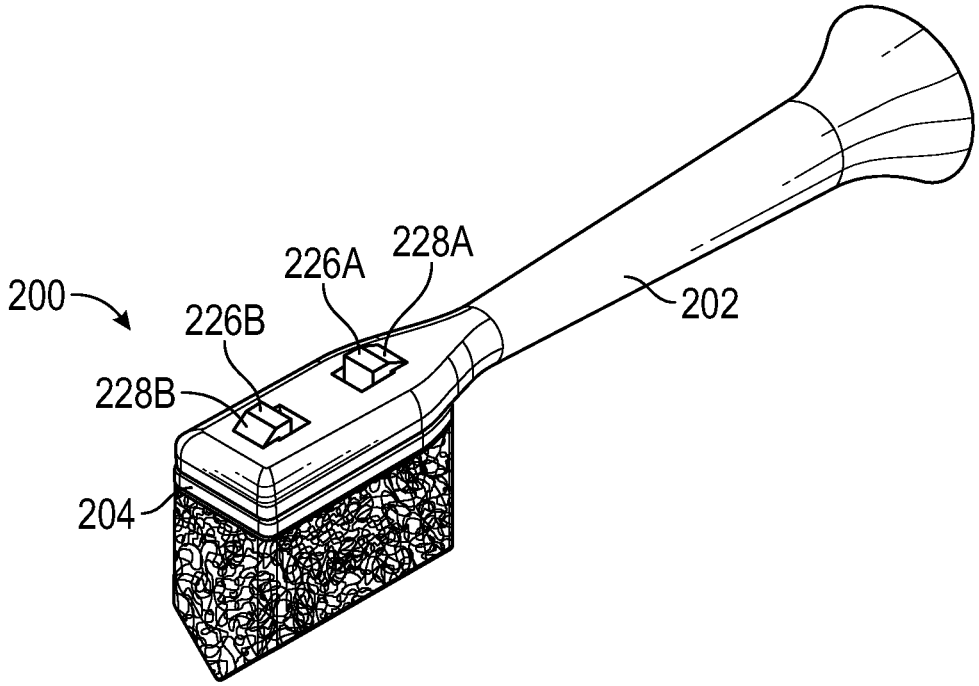
FIG. 8 is an isometric view of an embodiment of an adapter assembly according to the present disclosure.

FIG. 8 is an isometric view of an embodiment of an adapter assembly 200 (which may also be referred to herein as an attachment head 200). Except as otherwise noted below, the adapter assembly 200 may include some or all of the features of the adapter assembly 104 described herein. The adapter assembly 200 includes an adapter body 202 and a cleaning head 204 removably coupled to the adapter body 202. The adapter body 202 is described in more detail with reference to FIG. 9 and the cleaning head 204 is described in more detail in FIGS. 10A-10C. The adapter body 202 is structured to be attached to the sonic vibration device 102 (FIG. 2) and may include a mounting hole or other attachment mechanism for that purpose (not shown).

Figure 9:
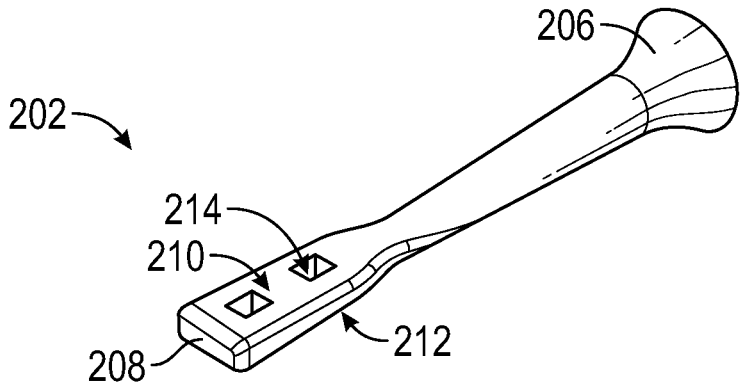
FIG. 9 is an isometric view of an adapter body of the adapter assembly of FIG. 8.

Turning to FIG. 9, the adapter body 202 includes a first end 206 and a second end 208 opposite to the first end 206. The first end 206 may generally be similar to the first end 124 of the adapter body 110 (FIG. 4). However, the second end 208 has a different shape and configuration. Specifically, the adapter body 202 tapers outwards towards the second end 208 with the adapter body 202 having a first surface 210 and a second surface 212 opposite to the first surface 210 at the second 208 that are both generally flat and planar. The adapter body 202 further includes a pair of apertures or holes 214 proximate the second end 208 with each of the apertures 214 extending completely through the body 202 from the first surface 210 to the second surface 212. The apertures 214 may be spaced from each other by a selected distance and also spaced from the second end 208 of the body 210 by a selected distance to accommodate different designs and configurations of the cleaning head 204 (FIG. 8).

Similarly, although FIG. 9 illustrates the apertures 214 as having a generally square or rectangular shape, in some embodiments, the apertures 214 have various selected shape for receiving corresponding structures on the cleaning head 204 (FIG. 8). In some embodiments, the body 202 is generally cylindrical at the first end 206 but transitions to a square or rectangular shape at the second end 208 with a thickness at the second end 208 that is less than a thickness or diameter at the first end 206. The body 202 may also have a width at the second end 208 that is greater than, equal to, or less than the width at the first end 206 in some embodiments.

Figure 10A:
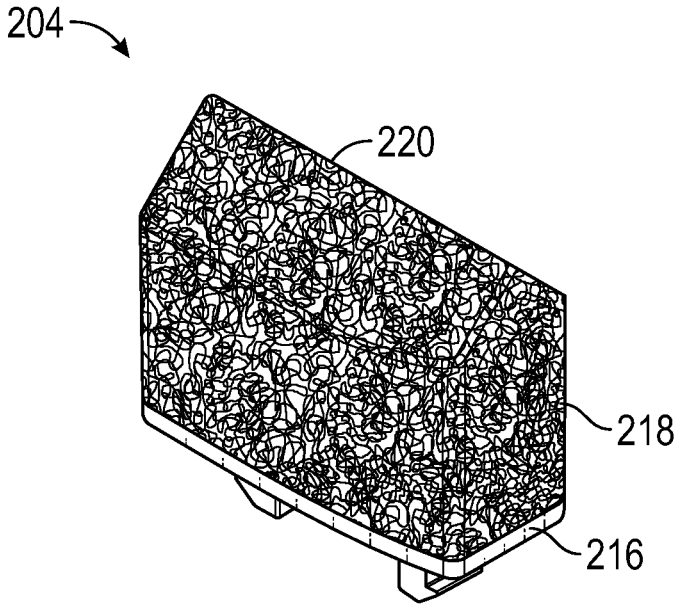
FIGS. 10A-10C are isometric views of a cleaning head of the adapter assembly of FIG. 8.
Figure 10B:
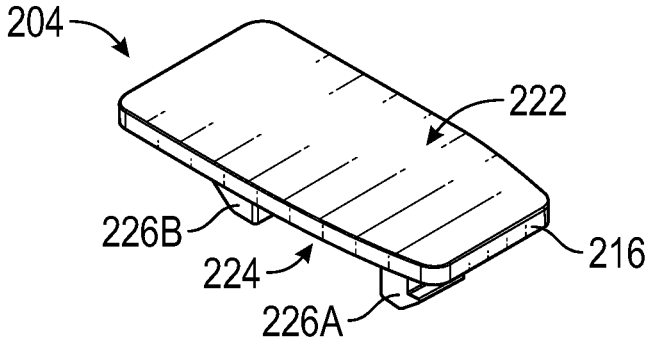
Figure 10C:
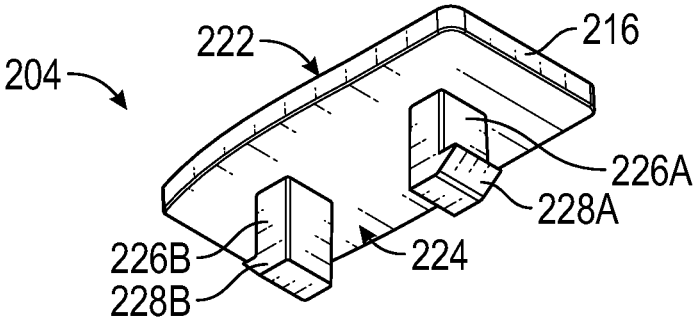

FIGS. 10A-10C are isometric views of the cleaning head 204 of the adapter assembly 200. Beginning with FIG. 10A, the cleaning head 204 includes a plate 216 (which may also be referred to herein as a support 216) with a cleaning tool 218 coupled to the plate 216. The tool 218 may be permanently coupled to the plate 216 or removably coupleable to the plate 216 with various fasteners or adhesives, such as glues, tapes, and the like. The cleaning tool 218 has a tip 220. In some embodiments, the cleaning tool 218 is a foam block with the tip 220 enabling cleaning in small or tight spaces with the larger side surfaces of the tool 218 enabling cleaning of larger or wider spaces.

FIG. 10B shows the plate 216 with the cleaning tool 218 removed for clarity. The plate 216 may have a first surface 222 and a second surface 224 opposite to the first surface 222 with the first surface 222 being generally flat and planar for receiving the cleaning tool 218. In some embodiments, the first surface 222 may include various protrusions, fasteners, and other like structures for removably engaging the cleaning tool 218. The plate 216 further includes a pair of protrusions 226A, 226B (which may also be referred to herein as a pair of attachment arms 226A, 226B) extending from the second surface 224 that are explained in additional detail with reference to FIG. 10C.

FIG. 10C is an isometric view of the second surface 224 of the plate 216. The plate 216 includes the protrusions 226A, 226B extending generally perpendicularly from the second surface 224 in some embodiments. The protrusions 226A, 226B may also be at any selected angle to the second surface 224. The protrusions 226A, 226B include respective ridges 228A, 228B extending perpendicularly or at any selected angle from the protrusions 226A, 226B and tapering to terminate in a pointed edge. As shown in FIG. 8, and with reference to FIG. 9, the ridges 228A, 228B extend through the apertures 214 and engage the adapter body 202 to removably couple the plate 216, and therefore the cleaning head 204, to the adapter body 202. The protrusions 226A, 226B may be spaced from each other and from edges of the plate 216 by a selected distance with the ridges 228A, 228B extending generally perpendicularly or at any selected angle to the protrusions 226A, 226B. Further, the ridges 228A, 228B may have a tapered or chamfered outer surface to provide a surface for the user to manipulate the ridges 228A, 228B and the protrusions 226A, 226B while uncoupling the cleaning head 204 from the adapter body 202. As with the adapter assembly 104 (FIG. 2), the adapter assembly 200 can include different cleaning head 204 configurations and tips 220, including any of the configurations or features described herein.

Figure 11:
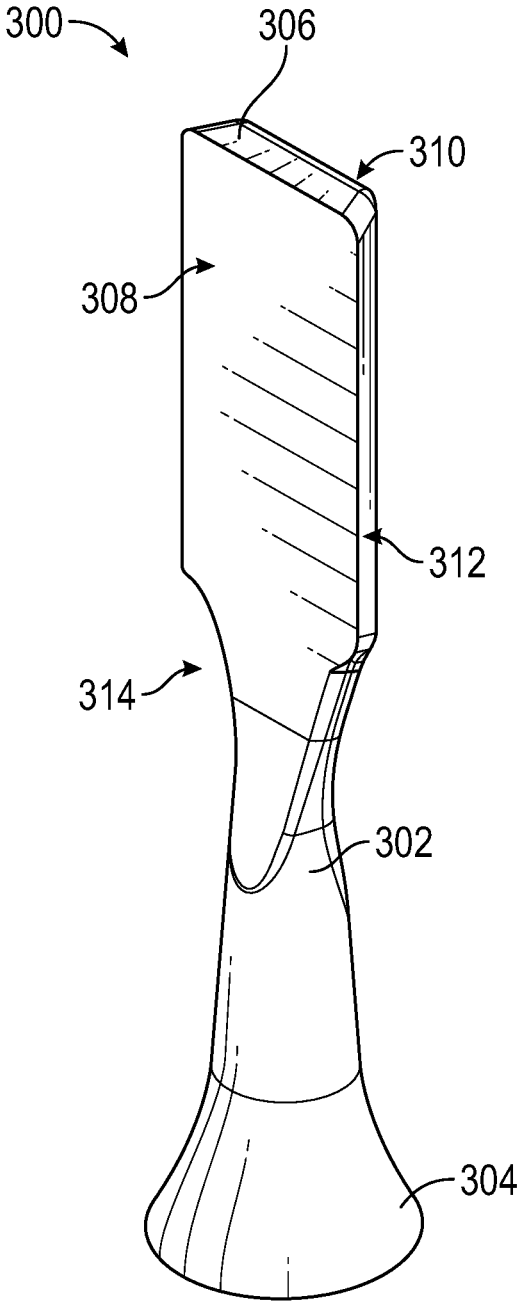
FIG. 11 is an isometric view of an embodiment of an adapter component according to the present disclosure.

FIG. 11 is an isometric view of an embodiment of an adapter component 300. The component 300 is a single piece component in some embodiments and includes a body 302 with a first or bottom end 304 and a second or top end 306. The first end 304 is removably coupleable to a sonic vibration device and the second end 306 is adapted for different cleaning applications. In particular, the second end 306 of the body has a trapezoidal cross-section with a first or front surface 308 having a greater area than a second or rear surface 310 opposite the first surface 308. Both the first and second surfaces 308, 310 have a greater area than a third or side surface 312. Each of the surfaces 308, 310, 312 may be flat and planar with the first and second surfaces 308, 310 being horizontal and the third surfaces 312 being at a selected angle to horizontal to connect the first and second surfaces 308, 310. The dimensions of the second end 306 (i.e., the dimensions of the cross-sectional shape) are generally constant over a height of the body 302 from the second end 306 to a transition portion 314 between the first and second ends 304, 306. The transition portion 314 may be located proximate a center of the body 302 or at a selected distance from a center of the body 302. In an embodiment, the dimensions of the second end 306 change over the height of the body 302, such as in a continuous manner (i.e., a continuous taper) or in a discontinuous manner (i.e., a step down or step up configuration, or a non-continuous taper).

In an embodiment, the adapter component 300 may be used with a cloth or other external cleaning device positioned over at least the second end 306 of the body 302. The different sizes of the surfaces 308, 310, 312 of the body 302 of the adapter component 300 enable a wide range of cleaning applications for surfaces of different shapes and sizes that are not achievable with conventional cleaning methods and devices. Alternatively, a cleaning tool may be coupled with adhesive to the first surface 308 or the second surface 310, or both. In yet further embodiments, a cleaning tool may be positioned over the second end 306, such as a removable sleeve including any of the cleaning or buffering materials described herein that is positioned over the second end 306 (i.e., the second end 306 is received internal to the sleeve). In particular, but not exclusively, the adapter component 300 provides a technological improvement for cleaning narrow spaces due to the low profile design. Further, vibration of the adapter component 300 via the sonic vibration device improves the cleaning efficiency and efficacy relative to using a cloth alone.

In view of the above, the concepts of the disclosure overcome the disadvantages of conventional cleaning devices, systems, and methods by providing adapter assemblies and cleaning tools that can efficiently and effectively clean both large and small spaces while having a low cost and being adaptable for use with conventional sonic vibration devices to increase applicability. Although not shown, the adapter assemblies and cleaning tools of the present disclosure can also be used with cleaning solution and towels or other cleaning devices to further increase their applicability and ability to clean different products and materials.

Certain words and phrases used in the specification are set forth as follows. As used throughout this document, including the claims, the singular form "a", "an", and "the" include plural references unless indicated otherwise. Any of the features and elements described herein may be singular, e.g., a sensor may refer to one sensor and a memory may refer to one memory. The terms "include" and "comprise," as well as derivatives thereof, mean inclusion without limitation. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Other definitions of certain words and phrases are provided throughout this disclosure.

Throughout the specification, claims, and drawings, the following terms take the meaning explicitly associated herein, unless the context clearly dictates otherwise. The term "herein" refers to the specification, claims, and drawings associated with the current application. The phrases "in one embodiment," "in another embodiment," "in various embodiments," "in some embodiments," "in other embodiments," and other variations thereof refer to one or more features, structures, functions, limitations, or characteristics of the present disclosure, and are not limited to the same or different embodiments unless the context clearly dictates otherwise. As used herein, the term "or" is an inclusive "or" operator, and is equivalent to the phrases "A or B, or both" or "A or B or C, or any combination thereof," and lists with additional elements are similarly treated. The term "based on" is not exclusive and allows for being based on additional features, functions, aspects, or limitations not described, unless the context clearly dictates otherwise. In addition, throughout the specification, the meaning of "a," "an," and "the" include singular and plural references.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the present disclosure.

Generally, unless otherwise indicated, the materials for making the invention and/or its components may be selected from appropriate materials such as metal, metallic alloys (high strength alloys, high hardness alloys), composite materials, ceramics, intermetallic compounds, plastic, 3D printable materials, thermosetting compounds, polymers, resins, concrete, foam, rubber, cotton, cloth, and the like.

The foregoing description, for purposes of explanation, uses specific nomenclature and formula to provide a thorough understanding of the disclosed embodiments. It should be apparent to those of skill in the art that the specific details are not required in order to practice the invention. The embodiments have been chosen and described to best explain the principles of the disclosed embodiments and its practical application, thereby enabling others of skill in the art to utilize the disclosed embodiments, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the breadth and scope of a disclosed embodiment should not be limited by any of the above-described embodiments, but should be defined only in accordance with the following claims and their equivalents.

The invention claimed is:

1. A modular sonic vibration buffer system, comprising:
an adapter assembly including:
an adapter body having a channel and a pair of opposing cavities; and
a plate removably coupled to the adapter body, the plate having a pair of opposing arms receivable in the pair of opposing cavities of the adapter body,
wherein when the plate and the channel of the adapter body are coupled together a cleaning tool mounting socket is formed between the channel of the adapter body and the plate;
a first cleaning tool including a support and a buffering tip; and
a second cleaning tool including a support and a buffering tip, the buffering tip of the second cleaning tool having a different buffering shape than the buffering tip of the first cleaning tool,
the first cleaning tool and the second cleaning tool being interchangeably coupleable to the adapter assembly with the support of the first cleaning tool or the support of the second cleaning tool received in the cleaning tool mounting socket of the adapter assembly.

2. The modular sonic vibration buffer system of claim 1, wherein the buffering tip of the first cleaning tool and the buffering tip of the second cleaning tool include one of cotton, foam, or rubber.

3. The modular sonic vibration buffer system of claim 1, wherein the plate includes a pair of ridges between the pair of opposing arms.

4. The modular sonic vibration buffer system of claim 1, wherein the channel of the adapter body is located between the pair of opposing cavities of the adapter body.

5. The modular sonic vibration buffer system of claim 1, wherein the adapter body includes a first end and a second end opposite to the first end, the adapter body further including a mounting hole in the first end of the adapter body, the channel and the pair of opposing cavities being located at the second end of the adapter body.

6. The modular sonic vibration buffer system of claim 5, further comprising:
a sonic vibration device with a mounting shaft, the adapter assembly being coupleable to the sonic vibration device with the mounting shaft of the sonic vibration device being receivable in the mounting hole of the adapter body, the sonic vibration device operable to vibrate one of the first cleaning tool or the second cleaning tool.

7. A modular sonic vibration buffer system, comprising:
an adapter assembly, including:
an adapter body having a pair of apertures; and
a plate removably coupled to the adapter body, the plate having a pair of arms receivable in the pair of apertures of the adapter body;
a first cleaning tool having a buffering tip; and
a second cleaning tool having a buffering tip, the tip of the second cleaning tool having a different buffering shape than the buffering tip of the first cleaning tool,
the first cleaning tool and the second cleaning tool being interchangeably coupleable to the adapter assembly.

8. The modular sonic vibration buffer system of claim 7, wherein the adapter body includes a mounting hole extending into the adapter body, the system further comprising:
a sonic vibration device with a mounting shaft, the adapter assembly coupled to the sonic vibration device with the mounting shaft of the sonic vibration device being receivable in a mounting hole of the adapter body, the sonic vibration device operable to vibrate one of the first cleaning tool or the second cleaning tool.

9. The modular sonic vibration buffer system of claim 8, wherein the adapter body includes a first end and a second end opposite to the first end, the mounting hole extending into the first end of the adapter body and the pair of apertures being located at the second end of the adapter body.

10. The modular sonic vibration buffer system of claim 7, wherein the adapter body includes a channel and the plate includes a pair of ridges extending from the plate, the pair of ridges of the plate received in the channel of the adapter body.

11. The modular sonic vibration buffer system of claim 10, wherein the first cleaning tool includes a support and the second cleaning tool includes a support, the support of the first cleaning tool and the support of the second cleaning tool interchangeably received between the pair of ridges of the plate.

12. The modular sonic vibration buffer system of claim 10, wherein the adapter assembly includes a cleaning tool mounting socket defined by the pair of ridges of the plate and the adapter body, the first cleaning tool and the second cleaning tool interchangeably received in the cleaning tool mounting socket of the adapter assembly.

13. The modular sonic vibration buffer system of claim 7, wherein at least one of the arms of the pair of arms of the plate includes a securement ridge receivable in one of the pair of apertures of the adapter body in a snap fit connection.

14. The modular sonic vibration buffer system of claim 7, wherein the buffering tip of the first cleaning tool and the buffering tip of the second cleaning tool include one of cotton, foam, or rubber.

15. A modular sonic vibration buffer system, comprising:

a first adapter assembly, including:

an adapter body having a channel and a pair of apertures, the channel located between the pair of apertures; and a plate removably coupled to the adapter body, the plate having a pair of arms receivable in the pair of apertures of the adapter body, wherein when the plate and the adapter body are coupled together, a cleaning tool mounting socket is formed;

a first cleaning tool having a buffering tip; and a second cleaning tool having a buffering tip, the buffering tip of the second cleaning tool having a different buffering shape than the buffering tip of the first cleaning tool, the first cleaning tool and the second cleaning tool being interchangeably coupleable to the first adapter assembly.

16. The modular sonic vibration buffer system of claim 15, further comprising:

a second adapter assembly having a length that is different than a length of the first adapter assembly, the second adapter assembly including:

an adapter body having a channel and a pair of apertures, the channel of the second adaptor assembly located between the pair of apertures of the second adaptor assembly; and a plate removably coupled to the adapter body of the second adaptor assembly, the plate of the second adaptor assembly having a pair of arms receivable in the pair of apertures of the adapter body of the second adaptor assembly, wherein when the plate of the second adaptor assembly and the adapter body are coupled together, a cleaning tool mounting socket is formed, the first cleaning tool and the second cleaning tool being interchangeably coupleable to the second adapter assembly.

17. The modular sonic vibration system of claim 16, further comprising:

a sonic vibration device, the first adapter assembly and the second adapter assembly interchangeably coupleable to the sonic vibration device.

18. The modular sonic vibration system of claim 15, wherein the buffering tip of the first cleaning tool is a foam block and the buffering tip of the second cleaning tool is a cotton swab with a pointed or rounded shape.

19. The modular sonic vibration system of claim 15, wherein the buffering tip of the first cleaning tool has a length and a width each greater than a length and a width of the buffering tip of the second cleaning tool.

20. The modular sonic vibration system of claim 15, wherein the first cleaning tool includes a support coupled to the buffering tip and the second cleaning tool includes a support coupled to the buffering tip, the support of the first cleaning tool or the support of the second cleaning tool being receivable in the cleaning tool mounting socket of the first adapter assembly.

* * * * *